US006676049B2

(12) United States Patent
van der Steur

(10) Patent No.: US 6,676,049 B2
(45) Date of Patent: Jan. 13, 2004

(54) BELL CUP POWDER SPRAY APPLICATOR

(75) Inventor: Gunnar van der Steur, Chesapeake City, MD (US)

(73) Assignee: EFC Systems, Inc., Havre de Grace, MD (US)

( * ) Notice: Subject to any disclaimer, the term of this patent is extended or adjusted under 35 U.S.C. 154(b) by 183 days.

(21) Appl. No.: 09/993,011

(22) Filed: Nov. 16, 2001

(65) Prior Publication Data

US 2003/0094519 A1 May 22, 2003

(51) Int. Cl.[7] ..... B05B 5/00; B05B 1/00; F23D 11/32

(52) U.S. Cl. ..... 239/690; 239/690.1; 239/700; 239/706; 239/600

(58) Field of Search ..... 239/690, 690.1, 239/700, 701, 702, 703, 706, 697, 698, 224, 223, 600, 390, 396

(56) References Cited

U.S. PATENT DOCUMENTS

| | | | | |
|---|---|---|---|---|
| 3,826,425 | A | | 7/1974 | Scharfenberger |
| 4,114,564 | A | | 9/1978 | Probst |
| 4,360,155 | A | | 11/1982 | Hubbell |
| 4,767,057 | A | | 8/1988 | Degli |
| 4,811,906 | A | | 3/1989 | Prus |
| 4,921,172 | A | | 5/1990 | Belmain |
| 5,215,261 | A | | 6/1993 | Frene |
| 5,249,748 | A | | 10/1993 | Lacchia |
| 5,310,120 | A | | 5/1994 | Ehinger |
| 5,353,995 | A | | 10/1994 | Chabert |
| 5,358,182 | A | | 10/1994 | Cappeau |
| 5,503,880 | A | | 4/1996 | Matschke |
| 5,662,272 | A | | 9/1997 | Buquet |
| 5,685,495 | A | | 11/1997 | Pham |
| 5,693,143 | A | | 12/1997 | Pham |
| 5,738,727 | A | | 4/1998 | Cebola |
| 5,744,190 | A | | 4/1998 | Thome |
| 5,788,165 | A | | 8/1998 | Sakakibara |
| 5,836,722 | A | | 11/1998 | Lacchia |
| 5,934,574 | A | | 8/1999 | van der Steur |
| 6,003,785 | A | | 12/1999 | Duey |
| 6,006,999 | A | | 12/1999 | Tiessen |
| 6,012,657 | A | * | 1/2000 | Knobbe et al. ..... 239/697 |
| 6,045,053 | A | | 4/2000 | Ruud |
| 6,105,886 | A | | 8/2000 | Hollstein |
| 6,189,804 | B1 | | 2/2001 | Vetter |
| 6,227,769 | B1 | * | 5/2001 | Wilson et al. ..... 406/181 |

* cited by examiner

*Primary Examiner*—Davis D. Hwu
(74) *Attorney, Agent, or Firm*—E. Alan Uebler, P.A.

(57) ABSTRACT

A rotating powder bell cup electrostatic spray assembly is provided. This assembly includes a bell cup body removably mated coaxially by screw threads to a first deflector, the assembly rotatably affixed to an air/powder supply. Preferably, the bell cup and first deflector are constructed from an insulative, non-stick material. The assembly includes unique, streamlined, preferably teardrop shaped, paddle deflectors. All corners around which powder passes are rounded, thereby achieving streamlined flow and little or no powder accumulation, as well as improved efficiency, ease of assembly and disassembly, and ease of cleaning for such devices. A preferred non-stick material of construction of the bell cup and first deflector is polytetrafluoroethylene.

20 Claims, 3 Drawing Sheets

BELL CUP POWDER SPRAY APPLICATOR

BACKGROUND OF THE INVENTION

The invention relates to rotary electrostatic spray applicators known as bell cup applicators for applying powder coatings to substrates. Such bell cup powder applicators are affixed to turbine housings through which are fed the powder to be sprayed in the form of an air-powder mixture under pressure. Electrostatic bell cup powder spray applicators are used to spray coat automotive vehicles, and various such devices are known. For example, U.S. Pat. No. 5,353,995 discloses a rotating ionizer head for the electrostatic application of an air-powder mixture, for coating objects with powder paint which is subsequently fused by heat. The ionizer head is rotated by a turbine and includes a deflector incorporating a charging electrode.

In such applications, the coating material is generally applied as a fine powder spray which is subsequently baked in a vehicle paint oven to form a durable coating thereon. As a substrate passes the rotating coating bell cup applicator assembly, electrically charged powder particles are discharged in a mist form. The ionized powder particles are attracted to the electrically charged (grounded) substrate to provide an evenly distributed coating on the substrate.

These spray applicators have a turbine body housing connected to a pneumatic line and a powder supply and delivery line. The turbine body is housed within the housing and motivates the air/powder mixture therethrough to the bell cup applicator assembly mounted at the forward end thereof. The powder passing axially through the turbine housing is ejected through the mount at the center of the rotating bell cup, which is maintained at a high voltage, and impinges on the rotating deflector thereof, at which it is redirected radially outwardly therefrom, forming the aforesaid powder mist used in coating various substrates.

The bell cup is generally shaped as a truncated frusto-conical body member, with its smaller diameter end oriented toward the turbine air/powder supply, and its larger diameter end flaring outwardly to its periphery. Spaced apart from the bell cup, and forming a uniform gap at the periphery thereof, is a deflector, which has a convex surface and which, in cooperative alignment with the bell cup, forms an annular, tapering passageway extending from the central, axial air/powder delivery passageway and tapering to the outer, peripheral uniform gap, from which the powder is ejected to coat a substrate passing thereby.

Powder that is forced under pressure axially through the bell cup assembly housing impinges upon the deflector as aforesaid, which is rotating at a high rate, and this powder is re-directed radially outwardly by vanes or paddles which are affixed within the passageway between the bell cup and deflector, and which drive the powder radially outwardly through the gap, forming essentially a frusto-conical ring of air and powder directed toward the substrate to be coated.

Other, electrostatic powder spraying devices having rotating, ionizing heads are known, e.g., in U.S. Pat. No. 4,114,564. In such devices, ionically charged powder particles flow from the spray assembly to the object to be coated, such as a vehicle, maintained at ground potential. The powder coating is subsequently baked thereon to form a uniform, durable coating on the substrate.

SUMMARY OF THE INVENTION

A rotatable powder bell cup electrostatic spray assembly is provided. This assembly is removably and coaxially attachable to rotational drive means which are attached to a non-rotating housing and feed nozzle through which a mixture of air and powder may be fed into the assembly. More specifically, this assembly includes a generally bell shaped body member removably and threadably connected concentrically to a first deflector member having connecting means removably and threadably insertable into the body member. The body member and first deflector member are cooperatively configured to form, when connected together, a tapered annular passageway therebetween extending from the rotational center thereof and tapering outwardly therefrom to the respective outer peripheries of the body member and first deflector member. At their outer peripheries these members form a uniform gap having a precision circumferential spacing therearound. The electrostatic spray assembly includes, within this passageway, a plurality of pillar-like, streamlined deflecting vanes extending generally perpendicularly from the first deflector member through this passageway, each vane containing at least one electrical connector therein which extends therethrough and which electrically connects an ionizing source in the housing to a conducting faceplate affixed to the external face of the first deflector, remote from the passageway. The faceplate has an emitting electrode extending externally from its axial center thereof. The body member and the first deflector member and the deflecting vanes are all constructed of electrically insulative material, preferably a non-stick plastic material, and polytetrafluoroethylene, e.g., Teflon®, is preferred.

In a preferred embodiment, the plurality of deflecting vanes and the first deflector member are integrally formed as a unitary construct. In addition, the deflecting vanes are streamlined in cross-sectional shape with respect to flow of powder particles thereover, and these streamlined deflecting vanes are preferably configured in the shape of teardrops having their respective forward edges blunt and rounded and their respective trailing edges tapered.

In the entire assembly, all surfaces adjacent to which the air/powder mixture flows are streamlined, that is, rounded, and contain no sharp corners. The body member and the first deflector member, at their respective outer peripheries at which these members form the discharging gap, have radiused edges.

The assembly has a faceplate electrically connected to the ionizing source in the housing by the electrical connectors passing through openings extending through the vanes, one connector within each vane, thereby isolating high voltage from all internal surfaces within this assembly over which the air/powder mixture flows. Each electrical conductor may be a conducting spring, constructed of a noncorrosive metal such as stainless steel.

The aforesaid connecting means may include at least one adjustable spacer which determines the insertion distance available to the first deflector member upon insertion into the body member. This spacer provides calibrated adjustability of the circumferential uniform gap spacing about the periphery of the assembly. This spacer may be a shim having a thickness in the range of 0.10 mm. to 1.00 mm., or other suitable thickness.

BRIEF DESCRIPTION OF THE DRAWINGS

In the accompanying drawings.

DETAILED DESCRIPTION OF THE INVENTION AND PREFERRED EMBODIMENTS WITH REFERENCE TO THE DRAWINGS

A rotating powder bell cup electrostatic spray assembly is provided. This assembly includes a bell cup body removably mated coaxially by screw threads to a first deflector, the assembly rotatably affixed to an air/powder supply. Preferably, the bell cup and first deflector are constructed from an insulative, non-stick material. The assembly includes unique, streamlined, preferably teardrop shaped, paddle deflectors. All corners around which powder passes are rounded, thereby achieving streamlined flow and little or no powder accumulation, as well as improved efficiency, ease of assembly and disassembly, and ease of cleaning for such devices. A preferred non-stick material of construction of the bell cup and first deflector is polytetrafluoroethylene.

Figure 1:
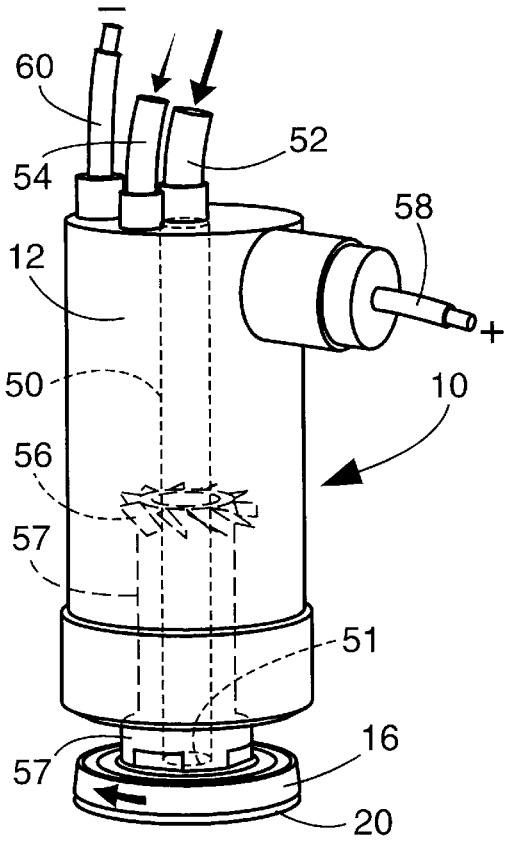
FIG. 1 is a perspective view of the bell cup powder spray applicator of the invention attached to its housing and air and air/powder supply lines.

A detailed description of the invention and preferred embodiments is best provided with reference to the accompanying drawings wherein FIG. 1 is a schematic perspective view of a rotary powder coating electrostatic spray applicator 10 according to the invention. The rotating bell cup applicator 16, with direction of rotation indicated by the arrow, is rotatably affixed to housing 12 which houses the air/powder supply channel 50 into which is fed the air/powder mixture through inlet means 52, indicated by the bold arrow shown. The turbine 56, which drives the rotational bell cup 16 through connecting shaft means 57, is housed within housing 12 and is air driven, with air being supplied through air inlet 54, indicated by the arrow shown.

Figure 2:
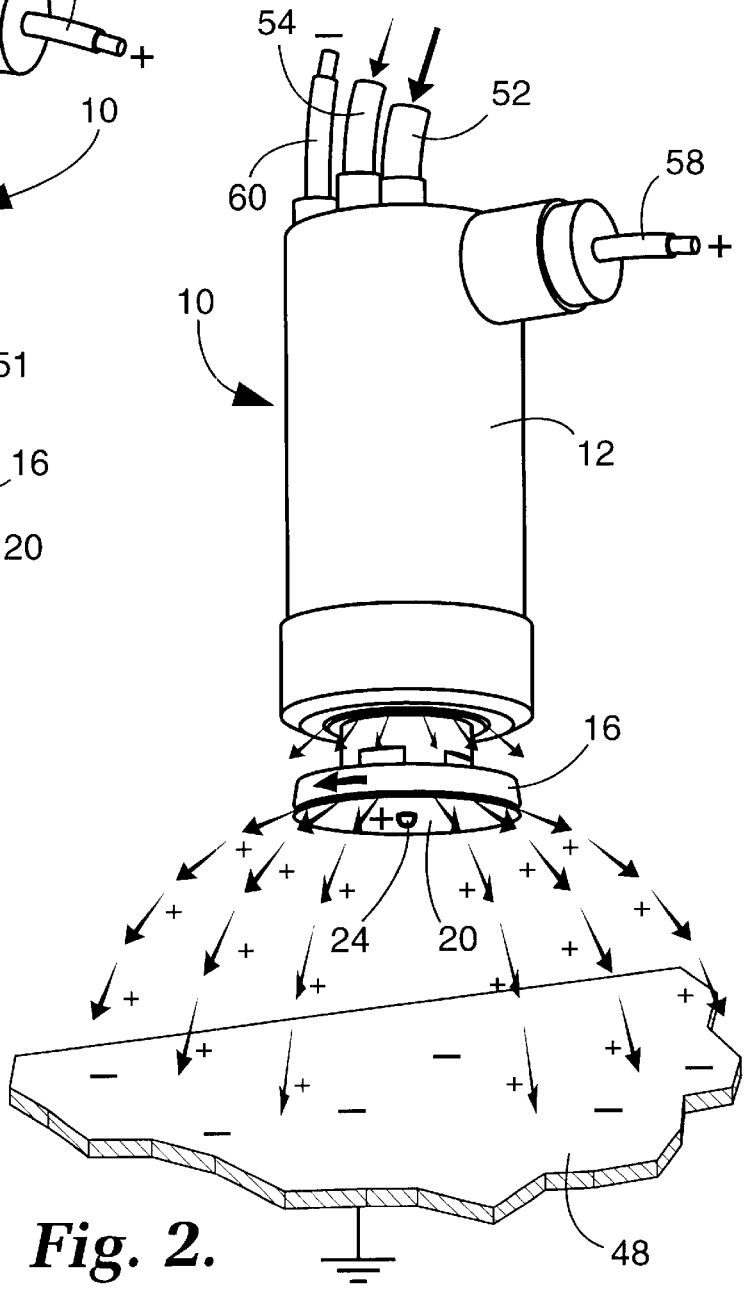
FIG. 2 is a perspective, schematic, partially exploded view of the spray applicator of the invention applying a powder spray to a substrate.

Connected to the outlet end of the air/powder supply channel 50 is the bell cup applicator 16, described more fully below. The discharged mixture of powder and air is transported through the internal passages of the rotating bell cup assembly from the non-rotating, coaxial supply channel 50. This mixture is thence discharged from the bell cup assembly in a lateral direction, at which point the powder acquires a charge by means of an electrostatic field emitted from and around electrode 24. The charged powder is then attracted to and deposited on grounded article 48, all as shown in FIG. 2. The electrostatic field is generated by electrical source 58, and the internal voltage potential is maintained above ground potential, indicated at 60. The pluses and minuses shown in FIG. 2 are intended to represent, schematically, the positively charged powder particles being emitted from the spray head 12 and being deposited onto the substrate 48 to be coated.

Figure 3:
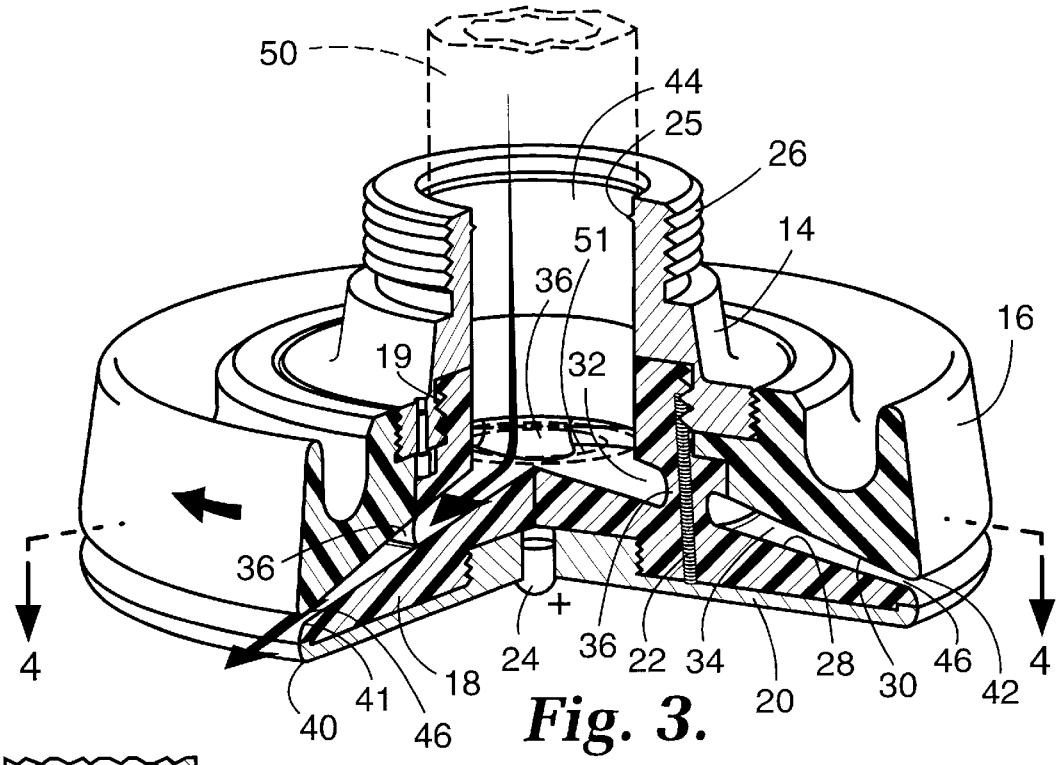
FIG. 3 is a perspective view, partially in cross-section, depicting the mating sub-assemblies which cooperatively engage to form the bell cup assembly used in the applicator of the invention.

The rotating bell cup spray applicator assembly is shown in greater detail in FIG. 3. Therein, the rotating bell cup assembly comprises two separate sub-assemblies, the bell cup body 16 and a first deflector member or insert 18. The bell cup body 16 has electrostatically isolative internal passages through which the air/powder coating mixture is transported from the stationary, non-rotating coaxial supply channel 50, through nozzle discharge outlet 51, into the central cavity 32 to and through an annular discharging outlet 46 extending around its outer periphery. The released discharging powder mixture is electrostatically charged by means of an ionized electrical field created from an electrostatic charge that is transported through the bell cup assembly to an electrode 24 positioned at the outer center of faceplate 20 affixed to the first deflector member 18 of the bell cup assembly.

Figure 3A:
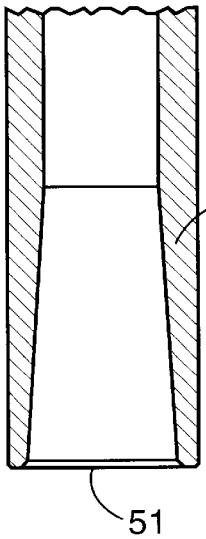
FIG. 3A is a side elevation, in cross-section, showing the nozzle discharge outlet from the air/powder supply channel into the bell cup assembly.

The bell cup body 16 is affixed to an electrically conductive mount 14. The mount 14 is of a configuration to allow the bell cup to be affixed, e.g., threadably, to the rotating shaft 57 of the compressed air turbine 56. Attached to the mount 14 as part of the bell cup sub-assembly, the bell cup body 16 is constructed of an electrically isolative material, preferably non-stick polytetrafluoroethylene, e.g., Teflon®. Together forming a sub-assembly, the mount 14 and body 16 are designed with a centrally located coaxial opening 44 to allow the supply channel 50 that protrudes through and out of the compressed air turbine, which transports the powder mixture, to extend through the mount and terminate centrally at the nozzle discharge 51 inside the bell cup assembly. A cross-sectioned, schematic detail of the supply channel 50, having nozzle discharge outlet 51, is depicted in FIG. 3A.

The assembly of the bell cup applicator includes the insert 18, which is a first deflector member that, like the body 16, is made of an electrically isolative material, preferably Teflon®, to which is attached the faceplate 20 made of an electrically conductive material such as aluminum, stainless steel or titanium. Along with the insert 18 and plate 20, included in the deflector assembly are contact springs 22 which transport the high voltage electrostatic charge, leading to electrode 24 which produces the electrostatic field. The disk shaped first deflector 18 is designed to be joined to the mount 14 by means of screw threads 19 that are located on the hub that is centrally coaxial with, and screwed into, the center opening in the mount 14. This central, threadable attachment operation provides for a simple, convenient design and permits ease of cleaning the entire assembly.

When the mount 14 and body 16 are affixed together as a unit of the bell cup, threadably as shown or by other means, the concave inner surfaces 30 of the body 16, along with the convex surfaces 28 of the upper assembly first deflector insert 18, combine to produce two cavities, 32, 34, inside the bell cup assembly, which include the rounded central cavity 32 and an annular radial cavity 34. Between these two cavities is a series of deflector vanes or "paddles" 36 that allow communication or passage of powder between them. The first deflector member 18 includes central rounded cavity 32 that is coaxial as aforesaid with the nozzle termination. The powder mixture that is transported through the supply channel 50 discharges through nozzle discharge 51 into the central cavity 32 inside the bell cup first deflector member 18. The powder that is discharging axially is then redirected radially by means of the convex surface 28 at the upstream end of the central cavity 32. The now radially moving powder mixture is directed into the annular radial cavity 34 by means of the paddles 36 that are positioned between the two internal bell cup cavities 32, 34, and are an integral part of the bell cup first deflector insert member 18. The paddles 36 are preferably of a teardrop shape in cross-section and skewed in the direction of the rotation of the bell cup as shown more clearly in FIG. 4, described below, with the rounded end of the teardrop end of the teardrop shape as the leading surface 38. The aforementioned convex surface 28 at the upstream end of the central cavity 32 is a continuous surface interrupted only by the paddles 36 that join the continuous convex surface 28 to the threaded first deflector insert member 18 hub.

To smooth the transition between the convex surface 28 and the paddles 36, all transition points are rounded or radiused. The rounded design of all the internal surfaces produces no sharp edges and/or transitions for impingement or collection of the powder mixture. Once the powder mixture is transported to the annular radial cavity 34 via the insert paddles 36, the powder travels between the convex surface 28 and the corresponding concave surface 30 out to the annular discharge outlet 46 at its periphery, that is, the periphery of the bell cup. The two surfaces 28, 30 that make up the annular radial cavity are of a design so as to progressively narrow the cross section of the cavity proceeding outwardly to its peripheral radiused annular discharge outlet 46, where the powder mixture is discharged from the bell cup assembly as indicated by the plurality of bold arrows in FIG. 4. The size or gap of the annular discharge outlet 46 is determined by the length of the threaded hub on the first deflector member insert 18 minus the depth of the threaded hole in the mount 14. In addition, the deflector insert 18 design allows for the installation of a "shim" 15 between the end of the threaded deflector hub 19 and the bottom of the threaded hole in the hollow mount 14, to produce various gap sizes of the annular discharge outlet 46, all discussed further below. The rounded design of all edges continues at the annular discharge outlet 46 by incorporating radii 41, 42 at its transitions from inner to outer bell cup surfaces. The discharged powder particles from the annular discharge outlet 46 are charged by bombardment of ions emitted by the electrode 24 positioned at the center of the faceplate 20 of the bell cup, depicted schematically as "pluses" in FIG. 2.

Returning to FIG. 3, the electrostatic charge that is emitted out of the electrode 24 enters the bell cup assembly at the mount 14. The mount 14 picks up a charge by means of an integrated protruding "V" barb 25 that runs radially and coaxially to the aforementioned clearance opening in the mount 14 for the air/powder supply channel 50, whose exterior shell transmits the charge to the V-barb 25. The electrostatic charge travels through the conductive mount 14 to the aforementioned contact springs 22 that are integral with the first deflector member 18 of the bell cup. The contact springs 22 are encapsulated within openings that are spaced radially outwardly from the bell cup central axis. These blind holes run from the forward face of the electrically isolative first deflector insert 18 through the center of the paddles 36 and along the root of the external threads 19 on the insert hub ending prior to the final thread as shown, thereby creating a blind hole in which to house the springs 22. The holes are positioned at a specific distance radially from the central axis so as to allow the housed springs 22 to be exposed to the mating thread on the conductive mount 14, thereby transferring the electrical charge from the mount 14 to the springs 22. The springs 22 run through the deflector insert 18 as shown, and, more specifically, through the center of the paddles 36. The springs 22 intersect perpendicularly through the center of the teardrop shaped paddles 36, allowing sufficient distance, that is, thickness of isolative material, to insulate the electrostatic charge from the powder being transported through the internal cavities 32, 34 of the bell cup assembly. The charge travels through the first deflector insert 18 by way of the spring 22 to the aforementioned insert assembly faceplate 20 that is electrically conductive. The faceplate 20 is affixed to the forward face of the insert 18 by means of screw threads that are coaxial with the insert hub and mount threads 19. The faceplate 20 houses the centrally located, protruding rounded "button" electrode 24 at the center of its external face. The faceplate 20 is also of a rounded edge design which incorporates a radiused edge 40 that matches and blends into the radius 41 of the insert 18 side of the annular discharge outlet 46. Designed for ease of cleaning, the faceplate 20 is advantageously coated with a non-conductive Teflon® PFA coating on the external surfaces of the faceplate 20. The internal or backside of the faceplate 20, when assembled onto the first deflector member assembly 18, contacts the contact springs 22 that are in the aforementioned insert holes, thereby transferring the electrical charge from the contact springs 22 through the faceplate 20, to the protruding button electrode 24, thereby generating an electrostatic field in which the discharged powder particles, from the annular discharge outlet 46, are electrostatically charged.

Figure 4:
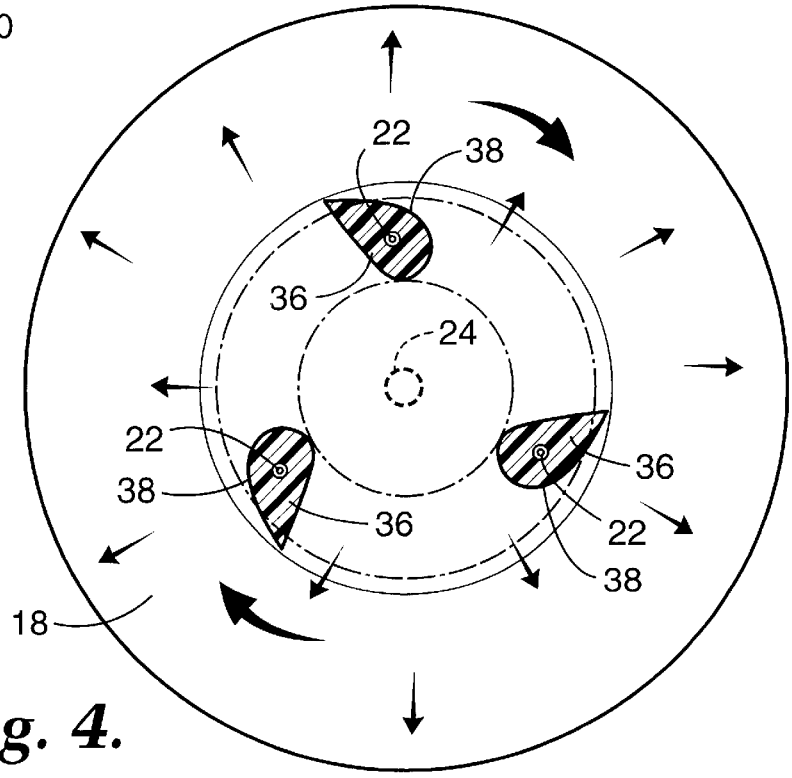
FIG. 4 is a top view, partly in cross-section, of the first deflector member insert depicted in FIG. 3, taken substantially along line 4—4 of FIG. 3.

FIG. 4 is a top plan view, partly in cross-section, taken along line 4—4 of FIG. 3, showing the first deflector member insert 18 and its integral deflecting vanes or "paddles" 36, the rotation of the deflector 18 during operation being indicated by the bold arrows. The deflecting vanes 36 are preferably molded or machined into the insert 18 as one piece, and these vanes extend through cavity 32 from floor to ceiling thereof, in pillar-like fashion. The vanes 36 are generally and preferably teardrop shaped in cross-section as shown, although other stream-lined configurations may be employed. The vanes 36 are skewed to the path of rotation of the deflector 18 to provide more even distribution of powder particles within cavities 32, 34. The external button electrode 24, which is positioned at the center of the faceplate 20 affixed to the insert 18, is indicated by the dashed lines. The springs 22 pass through the pillar-like paddles 36 through the openings therein, as shown. Three vanes 36 are depicted, although more or less may be satisfactory.

Deflector member (insert) 18 is constructed of an electrically insulative material and is preferably of a non-stick plastic material. The preferred material is a molded or machined polytetrafluoroethylene plastic, e.g., Teflon®. The several small arrows shown in this figure are intended to indicate the uniformity of powder flow over the surface of deflector member 18, with little or no accumulation or build-up of powder within any small nooks or crannies, which are non-existent in powder flow paths within the applicator assembly of this invention.

Figure 5:
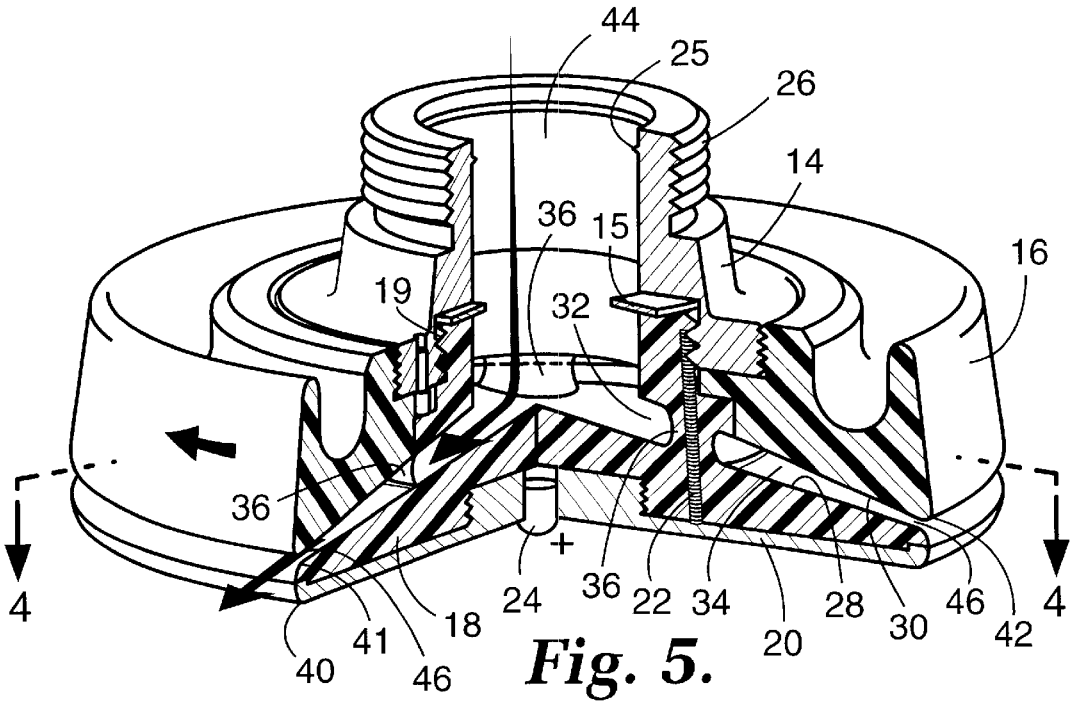
FIG. 5 shows the bell cup assembly substantially as shown in FIG. 3 but including a shim to provide a precision larger gap opening than that of the assembly of FIG. 3.

FIG. 5, which is similar to FIG. 3, depicts, partially in cross-section, an alternate embodiment of the rotatable bell cup electrostatic spray assembly of the invention. This assembly is removably attachable coaxially to the drive means of the housing 12 (depicted in FIGS. 1 and 2) by means of threaded connection 26 on the tapered conductive mount 14. Affixed to the conductive mount 14 is bell shaped, rotating body member 16, into which is inserted, by means of threads 19, the first deflector member 18, to which is attached the conducting faceplate 20, attached concentrically as shown. The body member 16 and the first deflector member 18 form, as shown, a tapered annular passageway 32, 34 extending from the rotational center of the assembly and tapering outwardly therefrom to the outer periphery of the assembly to form the uniform gap 46 thereat. Within the passageway 32, 34, as depicted in FIG. 5, are a plurality of deflecting vanes 36, three in total in this embodiment, which extend in pillar-like fashion through the passageway 32, 34. These vanes 36 are preferably molded or machined into, and are integral with, the first deflector member 18. Housed within each vane 36 and passing therethrough are electrical connectors 22, shown as springs 22, which extend through the vanes 36 and electrically connect the ionizing source 58 in the housing, connected to conductive hub of mount 14 by means of integrated protruding "V" barb 25, to the aforementioned faceplate 20. The faceplate 20 houses the centrally positioned button electrode 24 at its center thereof, from which ion bombardment is emitted, thereby electrically charging the powder particles passing outwardly from the assembly through the peripheral uniform gap 46, all as depicted schematically in FIG. 2.

In FIG. 5, the mount 14, body member 16, first deflector member 18 and faceplate 20 are all concentric and rotatable about the center thereof. The first deflector 18 and the deflecting vanes 36 are shown as a unitary construct and, in cross-section, are indicated to be electrically insulative plastic, as is the body member 16.

Within the passageway 32, 34, it is seen that all corners adjacent the powder flow path are rounded. At and around gap 46, all edges are radiused, e.g., the body member 16 at its outer edge has radius 42, the deflector member 18 at its outer edge has radius 41, and the faceplate 20 at its outer edge has radius 40.

Also shown in FIG. 5 is an adjustable spacer 15, shown as a shim, and inserted in the threaded connection between the mount 14 and the first deflector member 18. Insertion of shim 15 increases the spacing of gap 46 at the peripheral powder discharge, providing calibrated adjustability of the gap spacing circumferentially about the periphery of the assembly. Suitable shims, preferably constructed from a nonconductive material, i.e., a plastic, will have thicknesses ranging from 0.1 mm. to 1.0 mm., plus or minus 0.05 mm. They may be constructed of a variety of materials, positioned as they are at the conductive/insulative interface between members 14 and 16.

Figure 6:
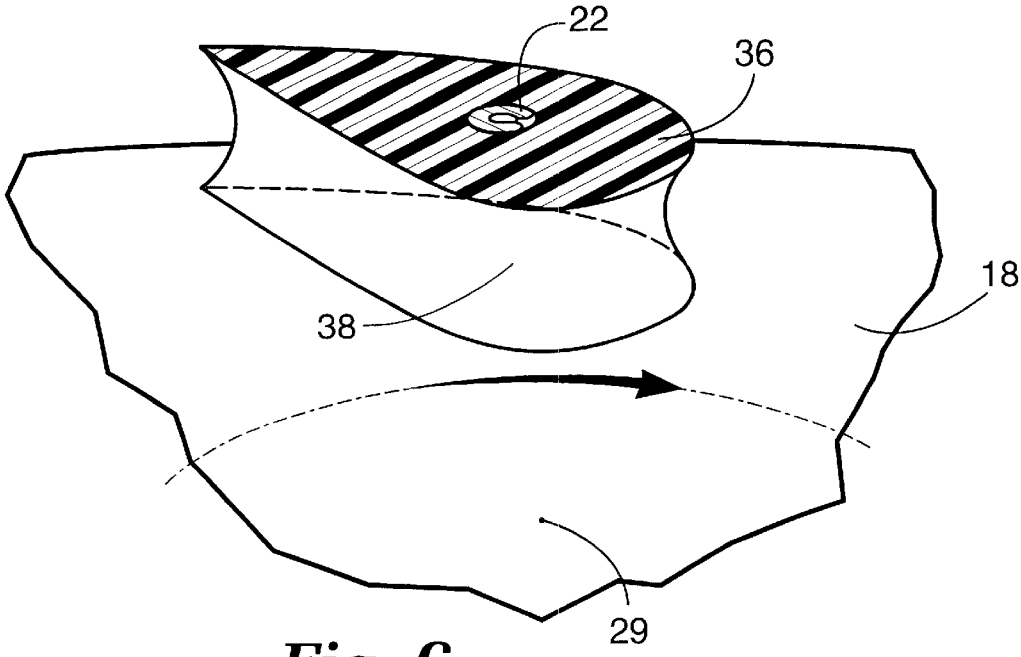
FIG. 6 is an exploded perspective view of one of the tear-drop-shaped paddle deflectors preferred for use in the spray applicator of the invention.

FIG. 6 shows, in an enlarged perspective view, partially in cross-section, an isolated deflecting vane 36, integrally molded or machined with first deflector member 18. These vanes 36 are streamlined in shape with respect to powder flow thereover. They are preferably shaped generally as teardrops, as shown, with their respective forward edges 38 blunt and rounded and their trailing edges tapered. Preferably the vanes 36 are slightly skewed with respect to the direction of rotation, rotation being around the axial centerpoint 29, as indicated in the figure.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. A rotatable powder bell cup electro-static spray assembly, which assembly is removably attachable to rotational drive means, the assembly being coaxially attachable to non-rotating housing and nozzle means through which a mixture of air and powder may be fed into said assembly, said assembly comprising:

a generally bell shaped body member removably and threadably connected concentrically to a first deflector member having connecting means removably and threadably insertable into said body member, said body member and said first deflector member cooperatively configured to form, when connected together, a tapered annular passageway therebetween extending from the rotational center thereof and tapering outwardly therefrom to the respective outer peripheries of the body member and first deflector member, at which outer peripheries these members form a uniform gap having a precision circumferential spacing therearound, said assembly being threadingly attachable to said rotational drive means.

2. The assembly of claim 1 wherein said connecting means includes at least one adjustable spacer which determines the insertion distance available to said first deflector member upon insertion into said body member, which spacer provides calibrated adjustability of the circumferential gap spacing about the periphery of said assembly.

3. The assembly of claim 2 wherein said spacer is a shim.

4. The assembly of claim 3 wherein said shim has a thickness in the range of 0.10 mm. to 1.00 mm.

5. A rotatable powder bell cup electro-static spray assembly, which assembly is removably attachable to rotational drive means, the assembly being coaxially attachable to non-rotating housing and nozzle means through which a mixture of air and powder may be fed into said assembly, said assembly comprising:

a generally bell shaped body member removably and threadably connected concentrically to a first deflector member having connecting means removably and threadably insertable into said body member, said body member and said first deflector member cooperatively configured to form, when connected together, a tapered annular passageway therebetween extending from the rotational center thereof and tapering outwardly therefrom to the respective outer peripheries of the body member and first deflector member, at which outer peripheries these members form a uniform gap having a precision circumferential spacing therearound, the assembly including, within said passageway, a plurality of deflecting vanes extending generally perpendicularly from said first deflector member through said passageway, each said vane containing at least one electrical connector therein and extending therethrough to electrically connect an ionzing source in said housing to a conducting faceplate affixed to the external face of said first deflector member, remote from said passageway.

6. The assembly of claim 5 wherein said faceplate has an emitting electrode extending externally from its axial center thereof.

7. The spray assembly of claim 5 wherein said body member and first deflector member and said deflecting vanes are all constructed of insulative material.

8. The spray assembly of claim 7 wherein said insulative material is a non-stick plastic material.

9. The spray assembly of claim 7 wherein said insulative material is polytetrafluoroethylene.

10. The spray assembly of claim 5 wherein said plurality of deflecting vanes and said first deflector member are integrally formed as a unitary construct.

11. The assembly of claim 5 wherein said deflecting vanes are streamlined in shape with respect to flow thereover.

12. The assembly of claim 11 wherein said streamlined deflecting vanes are configured in the shape of teardrops having their respective forward edges blunt and rounded and their respective trailing edges tapered.

13. The assembly of claim 12 having three streamlined deflecting vanes.

14. The assembly of claim 12 wherein said body member and said first deflector member, at their respective outer peripheries at which these members form said gap, have radiused edges.

15. The assembly of claim 5 wherein all surfaces adjacent to which the air/powder mixture flows are streamlined, that is, rounded, containing no sharp corners.

16. The assembly of claim 5 wherein said faceplate is electrically connected to said ionizing source in said housing by said electrical connectors passing through openings extending through said vanes, one connector within each vane, thereby isolating high voltage from all internal surfaces within said assembly over which the air/powder mixture flows.

17. The assembly of claim 16 wherein each electrical conductor is a conducting spring.

18. The assembly of claim 17 wherein each said spring is constructed of stainless steel.

19. A rotatable powder bell cup electrostatic spray assembly, which assembly is removably attachable to rotational drive means, the assembly being coaxially attachable to non-rotating housing and nozzle means through which a mixture of air and powder may be fed into said assembly, said assembly comprising:

a generally bell shaped body member removably and threadably connected concentrically to a first deflector member having connecting means removably and threadably insertable into said body member, said body member and said first deflector member cooperatively configured to form, when connected together, a tapered annular passageway therebetween extending from the rotational center thereof and tapering outwardly therefrom to the respective outer peripheries of the body member and first deflector member, at which outer peripheries these members form a uniform gap having a precision circumferential spacing therearound, said assembly including, within said passageway, a plurality of deflecting vanes extending generally perpendicularly from said first deflector member through said passageway, each said vane containing at least one electrical connector therein and extending therethrough to electrically connect an ionizing source in said housing to a conducting faceplate affixed to the external face of said first deflector member, remote from said passageway, wherein said faceplate has an emitting electrode extending externally from its axial center thereof, said body member and said first deflector member and said deflecting vanes all being constructed of polytetrafluoroethylene, and in which said plurality of deflecting vanes and said first deflector member are integrally formed as a unitary construct, said deflecting vanes configured in the shape of teardrops having their respective forward edges blunt and rounded and their respective trailing edges tapered, and wherein all surfaces adjacent to which the air/powder mixture flows are streamlined, that is, rounded, containing no sharp corners and said body member and said first deflector member, at their respective outer peripheries at which these members form said gap, have radiused edges.

20. The electrostatic spray assembly of claim 19 wherein each electrical conductor is a conducting spring constructed of stainless steel.

* * * * *